US008482507B2

(12) United States Patent
Han et al.

(10) Patent No.: US 8,482,507 B2
(45) Date of Patent: Jul. 9, 2013

(54) LIQUID CRYSTAL DISPLAY AND DRIVING METHOD THEREOF

(75) Inventors: Jaejung Han, Seoul (KR); Jigeun Nam, Seoul (KR); Jintaek Choi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 475 days.

(21) Appl. No.: 12/591,837

(22) Filed: Dec. 2, 2009

(65) Prior Publication Data

US 2010/0253615 A1 Oct. 7, 2010

(30) Foreign Application Priority Data

Apr. 1, 2009 (KR) ..... 10-2009-0028160

(51) Int. Cl.
*G09G 3/36* (2006.01)

(52) U.S. Cl.
USPC ..... 345/102; 345/690; 362/97.2; 362/617

(58) Field of Classification Search
USPC ..... 345/87–102, 690; 362/97.1–97.3, 362/617; 349/61–63, 65–66
See application file for complete search history.

(56) References Cited

U.S. PATENT DOCUMENTS 3,328,570 A * 6/1967 Balchunas ..... 362/615
5,854,872 A * 12/1998 Tai ..... 385/133
5,999,685 A * 12/1999 Goto et al. ..... 385/146
6,687,040 B2 * 2/2004 Kimura ..... 359/290
D493,566 S * 7/2004 Yu et al. ..... D26/122
6,885,360 B2 * 4/2005 Hara et al. ..... 345/102
7,658,530 B2 * 2/2010 Liu ..... 362/606
7,731,367 B2 * 6/2010 Whitehead et al. ..... 353/30
7,773,849 B2 * 8/2010 Shani ..... 385/131
7,802,911 B2 * 9/2010 Tanabe ..... 362/612
7,817,131 B2 * 10/2010 Seetzen ..... 345/102
7,990,360 B2 * 8/2011 Song et al. ..... 345/102
8,067,897 B2 * 11/2011 Park et al. ..... 315/291
8,111,223 B2 * 2/2012 Yeo et al. ..... 345/82
2004/0130884 A1 * 7/2004 Yoo et al. ..... 362/31
2005/0110810 A1 * 5/2005 Lee et al. ..... 345/690
2006/0002675 A1 * 1/2006 Choi et al. ..... 385/129

(Continued)

OTHER PUBLICATIONS

Won-Sik Oh; Daeyoun Cho; Kyu-Min Cho; Gun-Woo Moon; Byungchoon Yang; Taeseok Jang; , "A Novel Two-Dimensional Adaptive Dimming Technique of X-Y Channel Drivers for LED Backlight System in LCD TVs," Display Technology, Journal of, vol. 5, No. 1, pp. 20-26, Jan. 2009.*

*Primary Examiner* — Vijay Shankar
*Assistant Examiner* — Sanjiv D Patel
(74) *Attorney, Agent, or Firm* — McKenna Long & Aldridge LLP

(57) ABSTRACT

A liquid crystal display and a driving method thereof capable of improving contrast properties by implementing a local dimming and achieving the slimness of the liquid crystal display. The liquid crystal display comprises a liquid crystal display panel, a backlight unit including a light guide plate part in which a plurality of light guide channels are formed, and a plurality of light sources for illuminating light to the light guide channels, a division driving controller for mapping an input picture to a plurality of blocks in which a plurality of data channels are intersected with the plurality of light guide channels, analyzing luminance of the input picture for each block, determining dimming values of the plurality of light sources, and independently modulating the luminance of the input picture for each block based on the analyzed result, and a light source driver for independently controlling luminance of the light sources responding to the dimming values.

5 Claims, 10 Drawing Sheets

U.S. PATENT DOCUMENTS

2006/0139298 A1* 6/2006 Jin et al. ..... 345/102
2009/0021469 A1* 1/2009 Yeo et al. ..... 345/102
2009/0243982 A1* 10/2009 Lee et al. ..... 345/88
2010/0060554 A1* 3/2010 Koh et al. ..... 345/77
2010/0073275 A1* 3/2010 Kim ..... 345/102
2011/0242844 A1* 10/2011 Kim et al. ..... 362/607

* cited by examiner

LIQUID CRYSTAL DISPLAY AND DRIVING METHOD THEREOF

This application claims the benefit of Korea Patent Application No. 10-2009-0028160 filed on Apr. 1, 2009, which is incorporated herein by reference for all purposes as if fully set forth herein.

BACKGROUND OF THE INVENTION

1. Field of the Invention

Exemplary embodiments of the disclosure relate to a liquid crystal display and a method of driving the same capable of implementing a local dimming.

2. Discussion of the Related Art

A liquid crystal display has an increasing application range because of light-weight, thin, low-power consumption features. The liquid crystal display has been used for portable computers such as laptop computers, office automation apparatuses, audio/video devices, and indoor/outdoor advertisement displays. A transmissive type liquid crystal display which occupies all most liquid crystal display devices displays a desired picture by controlling an electrical field applied to liquid crystal layer to modulate light incident from a backlight unit.

Picture quality of the liquid crystal display depends on contrast property. The method improving the picture quality by modulating light incident from the backlight unit has a limitation. In order to improve the contrast property, a backlight dimming control method which adjusts luminance of the backlight unit according to the picture has been variously attempted. The backlight dimming control method may reduce power consumption by adaptably adjusting the luminance of the backlight unit depending on an input picture. The backlight dimming control method includes a global dimming method entirely adjusting luminance of a display screen and a local dimming method locally adjusting luminance of the display screen. The global dimming method may improve dynamic contrast measured between a previous frame and a next frame but it is difficult to improve static contrast. On the other hand, the local dimming method may improve static contrast by locally controlling luminance of the display screen in one frame period.

The backlight unit is mainly classified into a direct type and an edge type. The edge type backlight unit has a construction in which a light source is arranged to face a side surface of a light guide plate and a plurality of optical sheets are disposed between a liquid crystal display panel and the light guide plate. The edge type backlight unit may be implemented to have a structure thinner than the direct type backlight unit. However, it is impossible to apply the local dimming method to the edge type backlight unit because the light source illustrates light to one side of the light guide plate and the light guide plate serves to convert spot light or line light into surface light.

On the other hand, the direct type backlight unit has a construction in which a plurality of optical sheets and a diffusion plate are disposed under the liquid crystal display panel and a plurality of light sources are disposed under the diffusion plate. Even though the direct type backlight unit implements the local dimming method because the plurality of light sources are disposed under the diffusion plate and can be independently controlled, it is difficult to reduce a thickness thereof. Accordingly, it causes a problem to make a slim design of the liquid crystal display difficult. The reason why the direct type backlight unit can not be made to a slim construction is a space which is necessarily formed between the light sources and the diffusion plate. The diffusion plate diffuses light incident from the light sources to make luminance of the display screen uniformly. In order to sufficiently diffuse light incident from the light sources, the space between the light sources and the diffusion plate should be sufficiently guaranteed. According to the trend requiring the slim liquid crystal display, the space between the light sources and the diffusion plate is narrowed in gradual, but it makes bright lines on the display screen to lower a luminance evenness of the display screen because the light sources are observed on the display screen when the light from the light sources can not be sufficiently diffused. In order to improve the luminance evenness of the display screen, there have been proposed many resolutions such as a method increasing number and arrangement density of the light sources, a method enforcing a diffusing function by forming minute patterns or lens patterns on the diffusion plate facing the liquid crystal display panel and so on. However, the above methods also cause an increased cost and have definite limitations in respect of improving the diffusion of light.

SUMMARY OF THE INVENTION

Exemplary embodiments of the disclosure provide a liquid crystal display and a driving method thereof capable of improving contrast properties by implementing a local dimming method and achieving the slimness of the liquid crystal display.

In one aspect, there is provided a liquid crystal display including a liquid crystal display panel which displays a picture; a backlight unit including a light guide plate part in which a plurality of light guide channels are formed, and a plurality of light sources for illuminating light to the light guide channels, wherein the backlight unit divides surface light which is illustrated to the liquid crystal panel to correspond to the plurality of light guide channels; a division driving controller for mapping an input picture to a plurality of blocks in which a plurality of data channels are intersected with the plurality of light guide channels, analyzing luminance of the input picture for each block, determining dimming values of the plurality of light sources, and independently modulating the luminance of the input picture for each block based on the analyzed result; and a light source driver for independently controlling luminance of the light sources responding to the dimming values.

The division driving controller comprises a picture analyzer for obtaining a target luminance value for each block of the input picture, a data modulator for determining a first luminance value for each block in consideration of the target luminance and modulating the input picture according to the first luminance value, and a dimming controller for determining a second luminance value for each block in consideration of the target luminance and determining the dimming values according to the second luminance value, wherein the target luminance value for each block is obtained by summing the first luminance value and the second luminance value.

The first and second luminance values are sequentially determined, the luminance value which is determined previously is determined referring to the luminance value which is determined later.

The light guide plate part comprises a plurality of light guide plates which are formed in parallel each other and define the light wave channels.

The light guide plate part comprises a single light guide plate in which a plurality of intaglio pattern lines are formed to define the light guide channels.

The light source driver scanning-drives or normal-drives the light sources using the dimming values.

In another aspect, there is provided a method of driving a liquid crystal display having a liquid crystal display panel on which a picture is displayed. The method comprises (a) dividing surface light which is illustrated to the liquid crystal panel to correspond to a plurality of light guide channels using a light guide plate part in which the plurality of light guide channels are formed and a plurality of light sources for illuminating light to the light guide channels; (b) mapping an input picture to a plurality of blocks in which a plurality of data channels are intersected with the plurality of light guide channels, analyzing luminance of the input picture for each block, determining dimming values of the plurality of light sources, and independently modulating the luminance of the input picture for each block based on the analyzed result; and (c) independently controlling luminance of the light sources responding to the dimming values.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION OF THE ILLUSTRATED EMBODIMENTS

Hereinafter, exemplary embodiments of the invention will be described in detail with reference to the accompanying drawings so that this disclosure is thorough and complete and fully conveys the concept of the invention to those skilled in the art. This invention may, however, be embodied in many different forms and should not be construed as being limited to the embodiments set forth herein.

Referring to FIGS. 1 to 12B, exemplary embodiments of the disclosure are described in detail. In the exemplary embodiments, a light guide row (or a light guide column) indicates a light guide channel and a data block column (or a data block row) indicates a data block channel.

Figure 1:
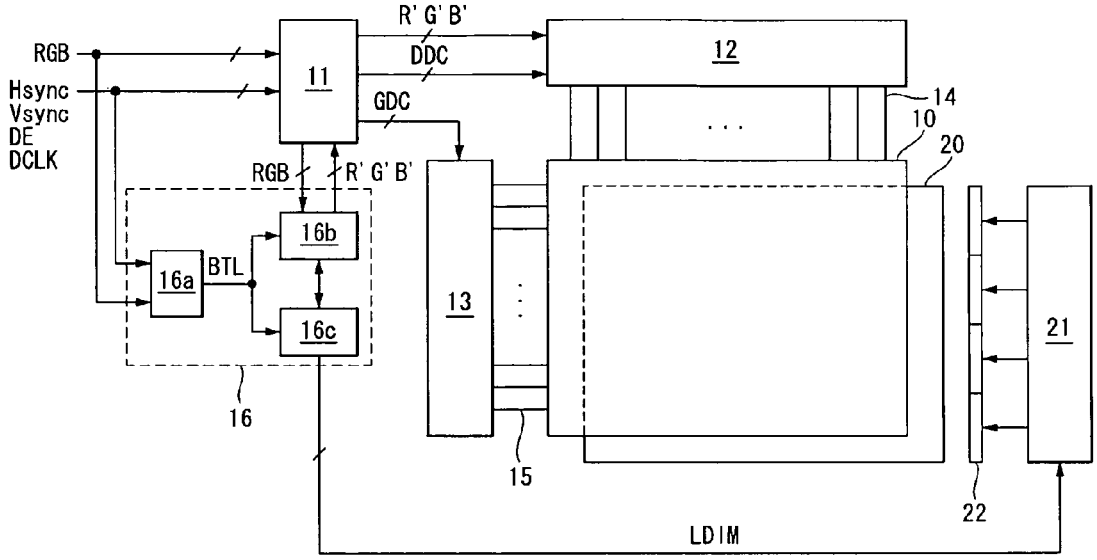
FIG. 1 is a block diagram showing a liquid crystal display according to a first exemplary embodiment of the invention.
Figure 2:
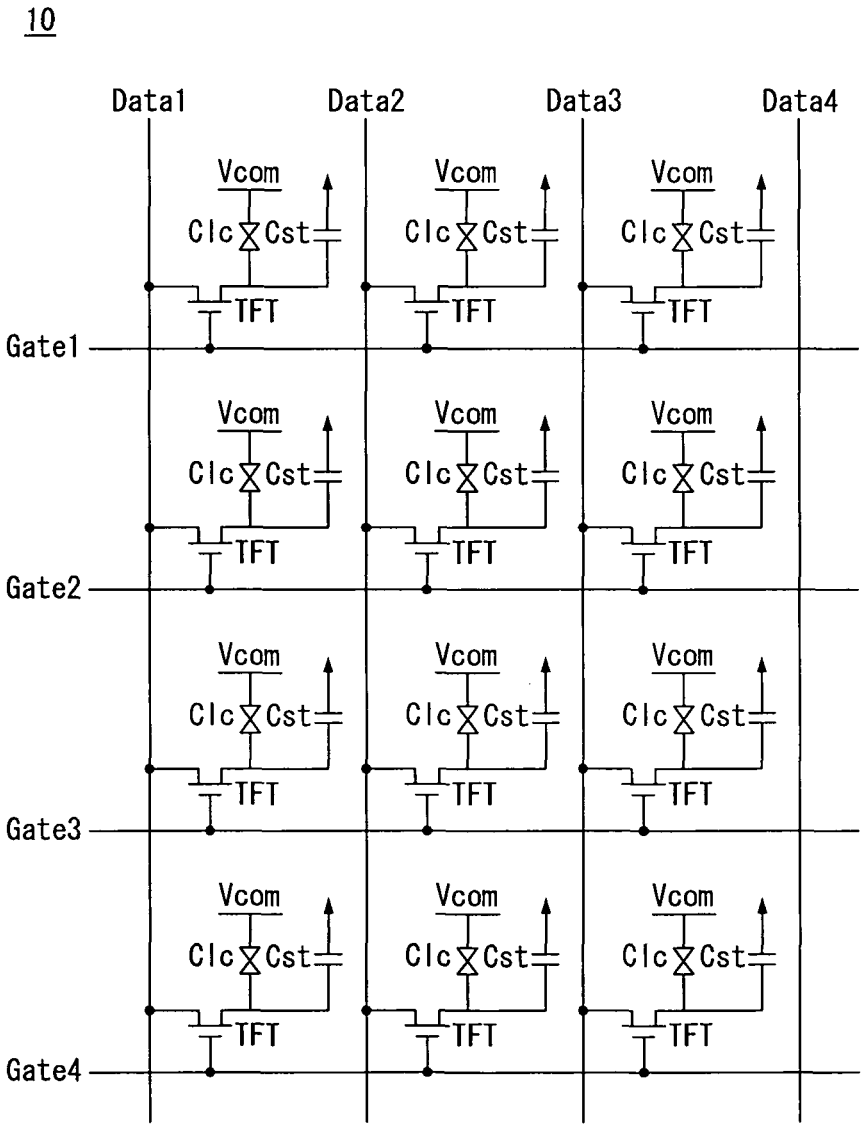
FIG. 2 is an equivalent circuit of a part of pixel array of the liquid crystal display shown in FIG. 1.
Figure 3:
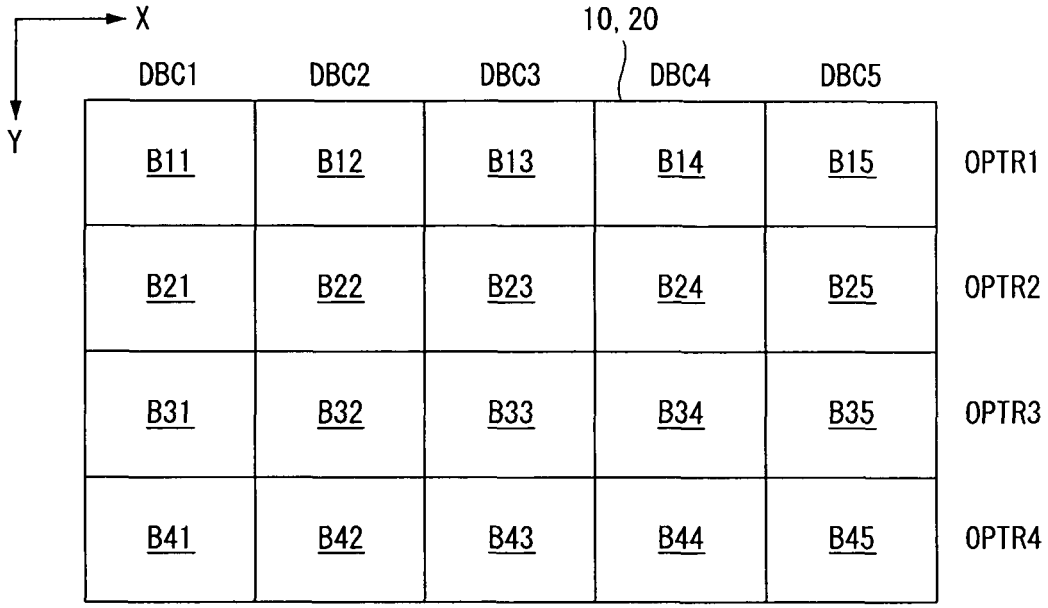
FIG. 3 is a diagram illustrating blocks partitioned by light guiding rows and data block columns.

Referring to FIGS. 1 to 3, a liquid crystal display according to an exemplary embodiment of the disclosure comprises a liquid crystal display panel 10, a data driving part 12 for driving data lines 14 of the liquid crystal display panel 10, a gate driving part 13 for driving gate lines 15 of the liquid crystal display panel 10, a timing controller 11 for controlling the data driving part 12 and the gate driving part 13, a backlight unit for illuminating light to the liquid crystal display panel 10, a light source driving part 21 for driving light sources 22 of the backlight unit, and a division driving controller 16 for analyzing an input picture and independently controlling display luminance in a block unit according to the analyzed result.

The liquid crystal display panel 10 includes liquid crystal layer formed between an upper glass substrate and a lower glass substrate. A plurality of data lines 14 are intersected with a plurality of gate lines 15 each other on the lower glass substrate. Liquid crystal cells Clc are arranged in the liquid crystal display panel 10 in a matrix type by the intersection of the data lines and the gate lines. Also, the data lines 14, the gate lines 15, thin film transistors (TFTs), pixel electrodes of the liquid crystal cells Clc connected to the TFTs, and storage capacitors Cst are formed on the lower glass substrate.

Black matrices, color filters and common electrodes are formed on the upper substrate. The common electrode is formed on the upper substrate in a vertical electrical field type driving method such as a twisted nematic (TN) mode and a vertical alignment (VA) mode, however is formed on the lower glass substrate together with the pixel electrode in a horizontal electrical field type driving method such as an in-plane switching (IPS) mode and a fringe field switching (FFS) mode. Polarizers are formed on the upper and lower glass substrates, respectively, and alignment layers are respectively formed on the inner surfaces of the substrates abutting with liquid crystals to set pre-tilt angle of the liquid crystals.

The data driving part 12 comprises a plurality of data driving integrated chips (ICs). Each of the plurality of data driving ICs includes a shift register for sampling a clock signal, a data register for temporarily storing the digital picture data RGB, a latch for storing the digital picture data by one line in response to the clock signals supplied from the shift registers and simultaneously outputting the stored digital picture data, a digital/analog converter for selecting a positive polarity gamma compensating voltage or a negative polarity gamma compensating voltage corresponding to the digital picture data supplied from the latch by referring to the gamma reference voltage, a multiplexer for selecting the data line to which the analog data converted by the positive polarity gamma compensating voltage or the negative polarity gamma compensating voltage is supplied, and an output buffer connected between the multiplexer and the data line 14. The data driving part 12 latches a modulated digital picture data R'G'B' under the control of the timing controller 11, converts the latched digital picture data into a positive or negative polarity analog data voltage using the positive or negative polarity gamma compensating voltage, and outputs the positive or negative polarity analog data voltage to the data lines 14.

The gate driving part 13 comprises a plurality of gate driving integrated chips (ICs). Each of the plurality of gate driving ICs includes a shift register, a level shifter converting an output signal supplied from the shift register into a signal having a swing width adapted to drive the TFT, and an output buffer connected between the level shifter and the gate lines 15. The gate driving part 13 sequentially outputs gate pulses (or scan pulses) having a pulse width of about one horizontal period under a control of the timing controller 11 and supplies them to the gate lines 15.

The timing controller 11 receives a digital picture data RGB from a system board to which an external picture source is mounted, supplies to the division driving controller 16, and supplies the modulated digital picture data R'G'B' to the data driving part 12. And, the timing controller 11 generates a data timing control signal DDC for controlling an operating timing of the data driving part 12 and a gate timing control signal GDC for controlling an operating timing of the gate driving circuit 13 based on the timing signals including a vertical synchronization signal Vsync, a horizontal synchronization signal Hsync, a data enable signal DE and a dot clock signal DCLK. The timing controller 11 inserts an interpolation frame between frames of the input picture signal which is input thereto in a frame frequency of 60 Hz, and controls the operation of the data driving part 12 and the gate driving part 13 in a frame frequency of 60*N (herein, N is an integer of two or more) by multiplexing the data timing control signal DDC and the gate timing control signal GDC.

The division driving controller 16 analyzes the input picture and independently controlling luminance of a display screen in a block unit according to the analyzed result. The division driving controller 16 comprises a picture analyzer 16*a*, a data modulator 16*b* and a dimming controller 16*c*.

The picture analyzer 16*a* analyzes the digital picture data RGB from the system board, maps it to the blocks B11 to B45 shown in FIG. 3 based on the analyzed result, and obtain a target luminance value BTL for each block by analyzing luminance of the digital picture data in a block unit using a diversity of picture analysis methods. In order to implement a local dimming, the blocks B11 to B45 are formed by a matrix structure in which X-directional (horizontal directional) light guide rows OPTR1 to OPTR4 dividing the display screen along Y-direction (vertical direction) are intersected with Y-directional (vertical directional) data block columns DBC1 to DBC5 dividing the display screen along x-direction (horizontal direction). The target luminance value BTL for each block may be obtained based on an average luminance value of the digital picture data RGB corresponding to each block or a maximum value of the digital picture data RGB corresponding to each block. The target luminance value BTL for each block may be obtained based on the most frequent value of the digital picture data RGB corresponding to each block by a histogram analysis result. The target luminance value BTL for each block is obtained by a sum of a first luminance value obtained from a data modulation of the data modulator 16*b* and a second luminance value obtained from a dimming value control of the dimming controller 16*c*.

The data modulator 16*b* determine the first luminance value for each block in consideration of the target luminance value BTL for each block from the picture analyzer 16*a*, independently modulates the digital picture data RGB in a block unit referring to the first luminance value for each block, and outputs the modulated digital picture data R'G'B'. The larger the first luminance value is become, the larger the modulation quantity of the picture digital data is become. However the less the first luminance value is become, the less the modulation quantity of the picture digital data is become.

The dimming controller 16*c* determines dimming values of the light sources 22 which illuminates light to the light guide rows OPTR1 to OPTR4 as a division dimming signal LDIM in consideration of the target luminance value BTL for each block from the picture analyzer 16*a*. The dimming values of light sources 22 is to achieve the second luminance value for each block, and are determined based on the maximum value for each of light guide rows OPTR1 to OPTR4 among the target luminance values BTL of the light guide rows OPTR1 to OPTR4.

The first and second luminance values for each block are sequentially determined, and a luminance which is determined later is obtained referring to the luminance which is previously determined. For example, in case that modulation quantity of the digital picture data RGB is predetermined, the second luminance value for each block can be determined by determining the dimming values of the light sources referring to the first luminance value for each block. On the contrary, in case that dimming value of the light sources is predetermined, the first luminance value for each block can be determined by determining the modulation quantity of the digital picture data RGB referring to the second luminance value for each block.

The division driving controller 16 is mounted on the system board or integrated into the timing controller 11. In particular, the division driving controller 16 synchronizes driving timing of the light sources 22 with display timing of the modulated digital picture data R'G'B' by synchronizing operation timings of the data modulator 16*b* and the dimming controller 16*c* using the timing signals Vsync, Hsync, DE and DCLK.

The backlight unit includes a light guide plate part 20, and the light sources 22 for illuminating light to left and/or right side of the light guide plate part 20. Also, the backlight unit includes a plurality of optical sheets disposed between the light guide plate part 20 and the liquid crystal display panel 10. The light guide pate part 20 is made of a flat plate including a transparent resin or a wedge plate wedge plate of which lower surface is inclined. In order to implement the local dimming by dividing surface light incident to the liquid crystal display panel 10 into blocks as shown in FIG. 3, a structure of the light guide plate 20 can be changed in various.

Figure 4:
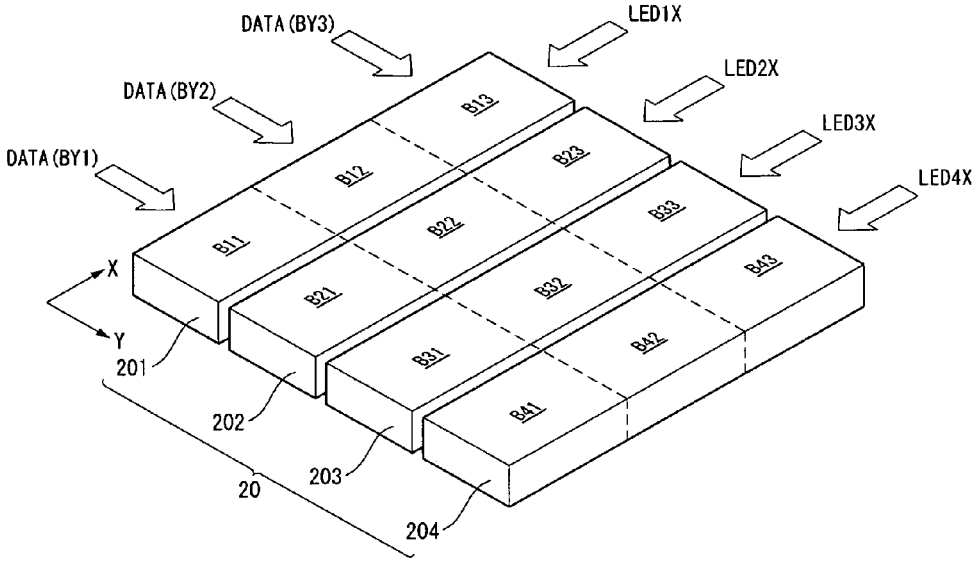
FIGS. 4 to 5B are enlarged perspective views showing a part of a light guide plate in which the blocks shown in FIG. 3 are partitioned.

As one example, the light guide plate part 20 includes a light guide plate array including a plurality of light guide plates 201 to 204 which are arranged in parallel with each other along Y-direction to define X-directional light guide rows. In this case, the light sources 22 are disposed to face left and/or right side of the light guide plate part 20 to illustrate light to the X-directional light guide rows, respectively. In FIG. 4, symbols LED1X to LED4X indicate light which illustrates from the light sources 22 to light incident surfaces of the light guide plates 201 to 204, and divide display luminance of the display screen in a unit of X-directional light guide row. Also, symbols DATA(BY1) to DATA(BY3) indicate modulation block data which are to divide the display luminance of the display screen in a unit of Y-directional data block column. The local dimming is implemented by controlling the display luminance in a block unit using lights LED1X to LED4X and the modulation block data which are independently controlled.

Figure 5A:
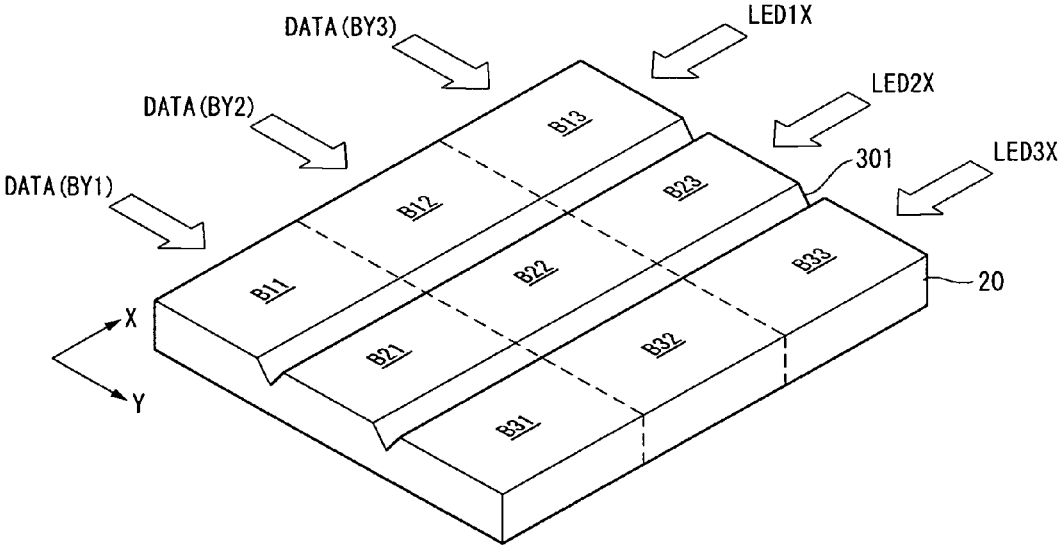
Figure 5B:
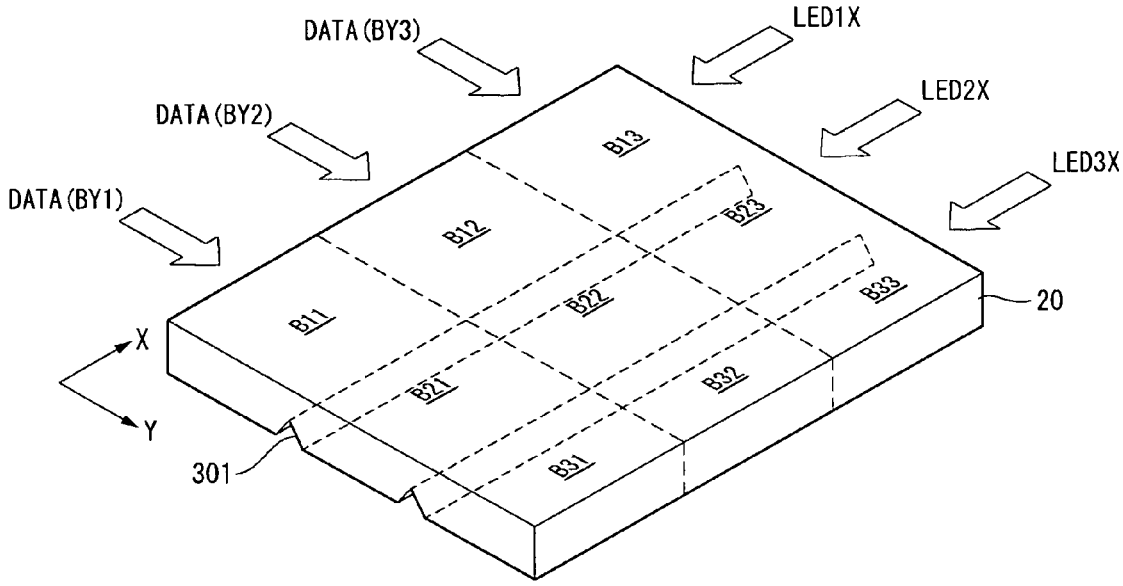
Figure 6A:
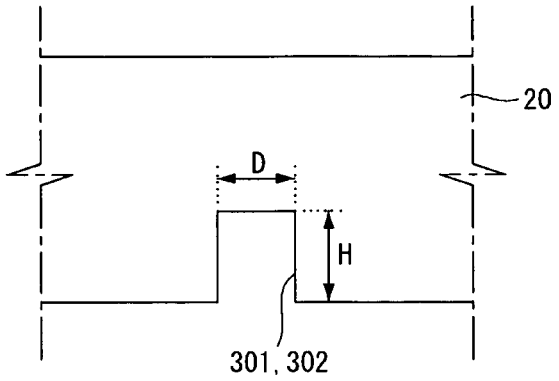
FIGS. 6A to 6C are sectional views which illustrates a cross section of an intaglio pattern line.
Figure 6B:
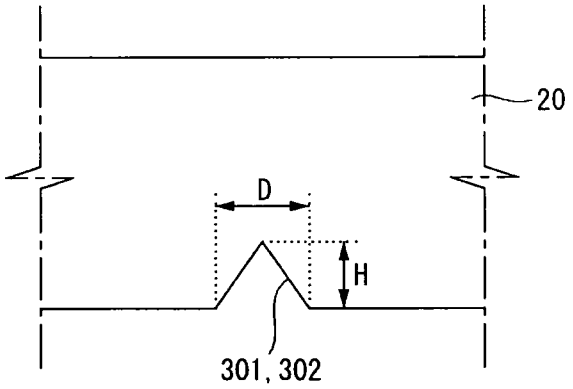
Figure 6C:
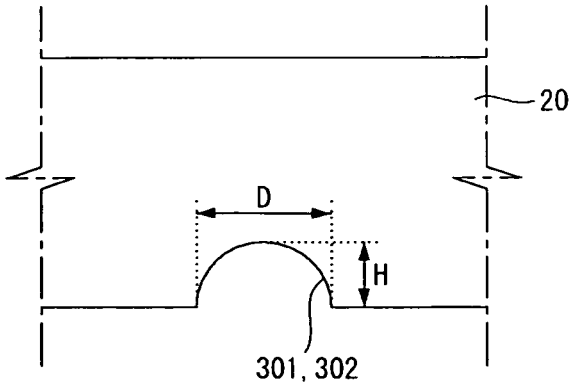
Figure 7:
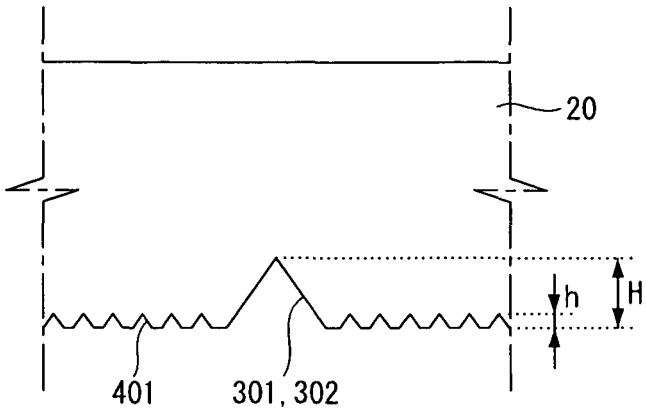
FIG. 7 is a sectional view which illustrates a cross section of an intaglio pattern line and minute intaglio-embossed patterns.

As another example, the light guide plate part 20 includes a single light guide plate in which X-directional intaglio pattern lines are formed to define X-directional light guide rows as shown in FIGS. 5A to 5B. FIG. 5A shows an example in which X-directional intaglio pattern lines are formed on an upper surface of the light guide plate part 20, and FIG. 5B shows another example in which X-directional intaglio pattern lines are formed on an under surface of the light guide plate part 20. In these cases, the light sources 22 are disposed to face left and/or right side of the light guide plate part 20 to illustrate light to the X-directional light guide rows, respectively. The X-directional intaglio pattern lines 301 enhance going-straight property of light from the light sources 20. Each of the X-directional intaglio pattern lines 301 is formed by linear groove having a depth smaller than the thickness of the light guide plate part 20 to divide the light guide plate part 20 into a plurality of X-directional light guide rows. In FIGS. 5A and 5B, symbols LED1X to LED3X are indicate light which illustrates from the light sources 22 to light incident surfaces of the light guide plate part 20, and divide display luminance of the display screen in a unit of X-directional light guide row. Also, symbols DATA(BY1) to DATA(BY3) indicate modulation block data which are to divide the display luminance of the display screen in a unit of Y-directional data block column. The local dimming is implemented by controlling the display luminance in a block unit using lights LED1X to LED4X and the modulation block data which are independently controlled. The intaglio patter lines 301 can be implemented in a variety of sectional shapes such as a rectangular shape, a triangular shape, a semi-spherical shape, an oval shape or a combination thereof as shown in FIGS. 6A to 6C. It is possible to adjust a depth H, width D and distance of the intaglio pattern lines according to a block size shown in FIG. 3 and size and resolution of the liquid crystal display panel.

On the light guide plate part 20 shown in FIGS. 4 to 5B, minute intaglio or convex patterns 401 in addition to the intaglio pattern lines 301 may be formed as shown in FIG. 12. The minute intaglio or convex patterns 401 are formed at least one surface of each of the light guide plate part 20. The minute intaglio or embossed patterns 401 reflect the light in the light guide channels to the optical sheets and the liquid crystal display panel 10. The more minute intaglio or embossed patterns 401 are far from the light sources 20, the more minute intaglio or embossed patterns 401 are formed in dense. It compensates the luminance at the position far from the light sources to enhance the evenness of the surface luminance in each of the light guide channels. For example, in case that the light sources 20 are formed at only one side of the light guide plate part 20, the minute intaglio or embossed patterns 401 are formed on the upper or lower surface of the light guide plate part 20 so that the more minute intaglio or embossed patterns 401 are far from the other side of the light guide plate part 20, the more minute intaglio or embossed patterns 401 are formed in dense. In case that the light sources 22 are formed at both sides of the light guide plate part 20, the minute intaglio or embossed patterns 401 may be formed on the upper or lower surface of the light guide plate part 20 so that the more minute intaglio or embossed patterns 401 are near to a central position of the light guide plate part 20, the more minute intaglio or embossed patterns 401 are formed in dense. In FIGS. 5A and 5B, a first depth H of the intaglio pattern lines 30 is larger than a second depth h of the minute intaglio or embossed patterns 401. For example, the ratio of the first depth H to the second depth h is as follows:

h:H=1:2 to 1000

The light sources 22 include a plurality of point light sources such as light emitting diodes (LEDs). The light sources are disposed to face at least one of the right and left sides of the light guide plate part 20 to emit the light to the X-directional light guide rows. The amount of emitting light of each light source 20 is independently controlled by current supplied from the light source driving part 21.

The light source driving part 21 independently adjusts the intensity of current supplied to the light sources 22 under the control of the division driving controller 16. The light source driving part 21 heightens current supplied to a light source facing to the light incident surface of the X-directional light guide row which includes a bright block in display screen in respond to the division dimming signal LDIM. On the contrary, the light source driving part 21 lowers current supplied to a light source facing to the light incident surface of the X-directional light guide row which includes a dark block in display screen in respond to the division dimming signal LDIM.

Figure 8:
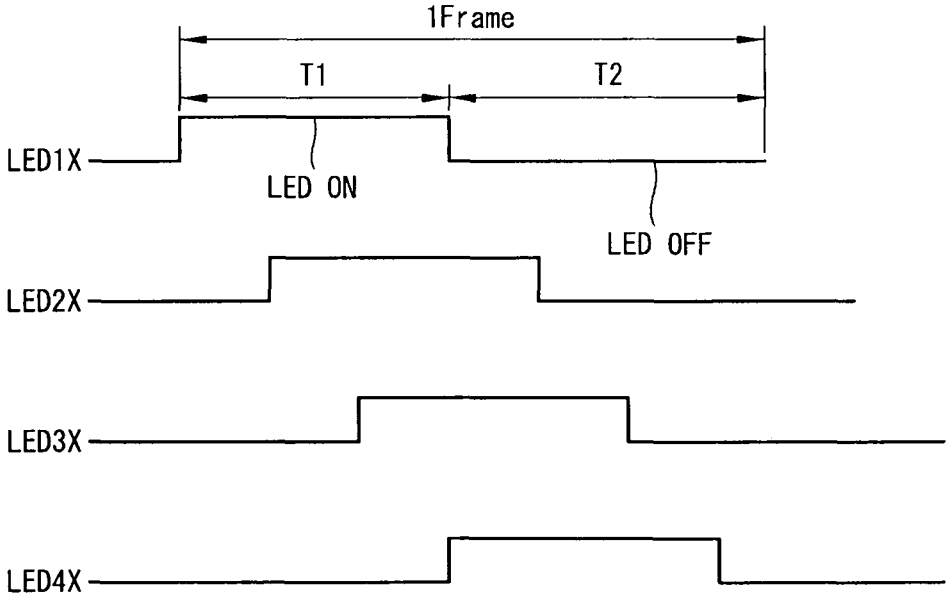
FIG. 8 is a timing diagram illustrating scanning driving of light sources.
Figure 9:
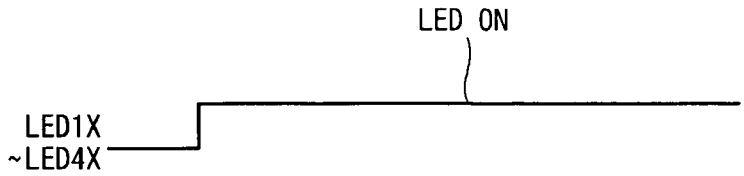
FIG. 9 is a timing diagram illustrating normal driving of light sources.
Figure 10:
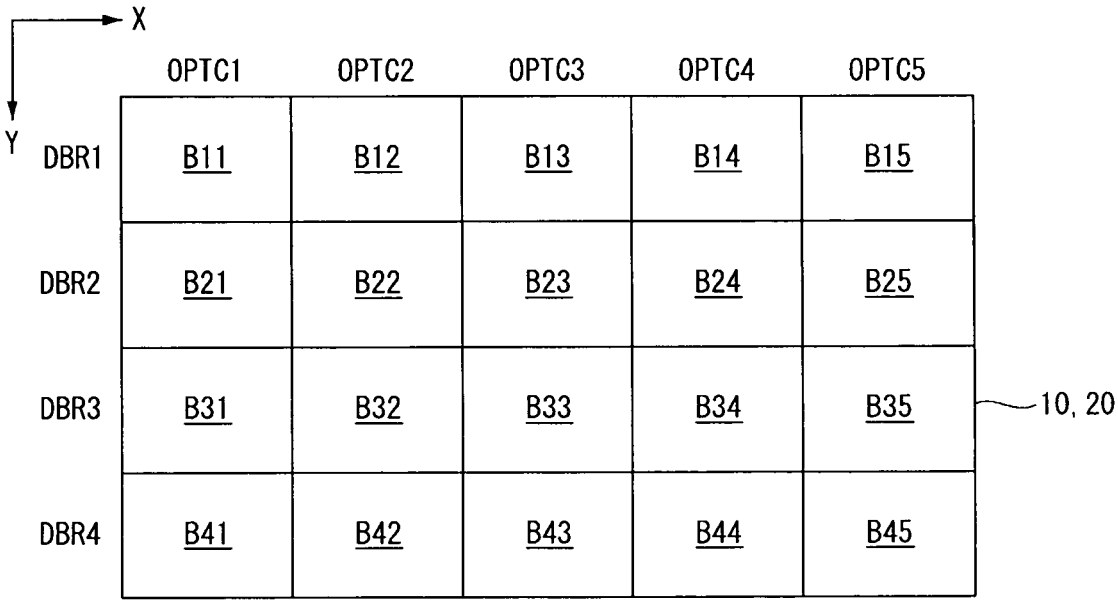
FIG. 10 is a diagram illustrating blocks partitioned by light guide columns and data block rows.

The light source driving part 21 performs a scanning or normal driving of the light sources 22 based on the dimming values included in the division driving signal LDIM under the control of the division driving controller 16. FIG. 8 is a timing diagram which illustrates an example of the scanning driving the light sources 22. The light source driving part 21 divides one frame period in which one picture is displayed into a light driving period T1 and a light source non-driving period T2, and sequentially driving the light sources 22 referring to the scanning time of the gate driver 13. When the light sources 22 are scanning-driven by using the division dimming signal LDIM, it is possible to improve a motion blur phenomenon inherent to a liquid crystal display because there is an effect like as an impulse driving. FIG. 9 is a timing diagram which illustrates an example of the normal driving the light sources.

On the other hand, the light sources 22 are disposed to face upper and/or under side of the light guide plate part 20 in the drawing to illustrate light to the Y-directional light guide columns, respectively. In this case, in order to implement a local dimming, the blocks B11 to B45 are formed by a matrix structure in which Y-directional light guide columns OPTC1 to OPTC5 dividing the display screen along X-direction are intersected with X-directional data block rows DBR1 to DBR4 dividing the display screen along Y-direction. The dimming controller 16*c* determines the dimming values of the light sources 22 which illustrate light to the light guide columns OPTC1 to OPTC5 as the division dimming signal in consideration of the target luminance value BTL for each block supplied from the picture analyzer 16*a*. In order to divide the luminance of surface light incident to the liquid crystal display panel 10 into the light guide columns OPTC1 to OPTC5, a structure of the light guide plate 20 can be changed in various.

Figure 11:
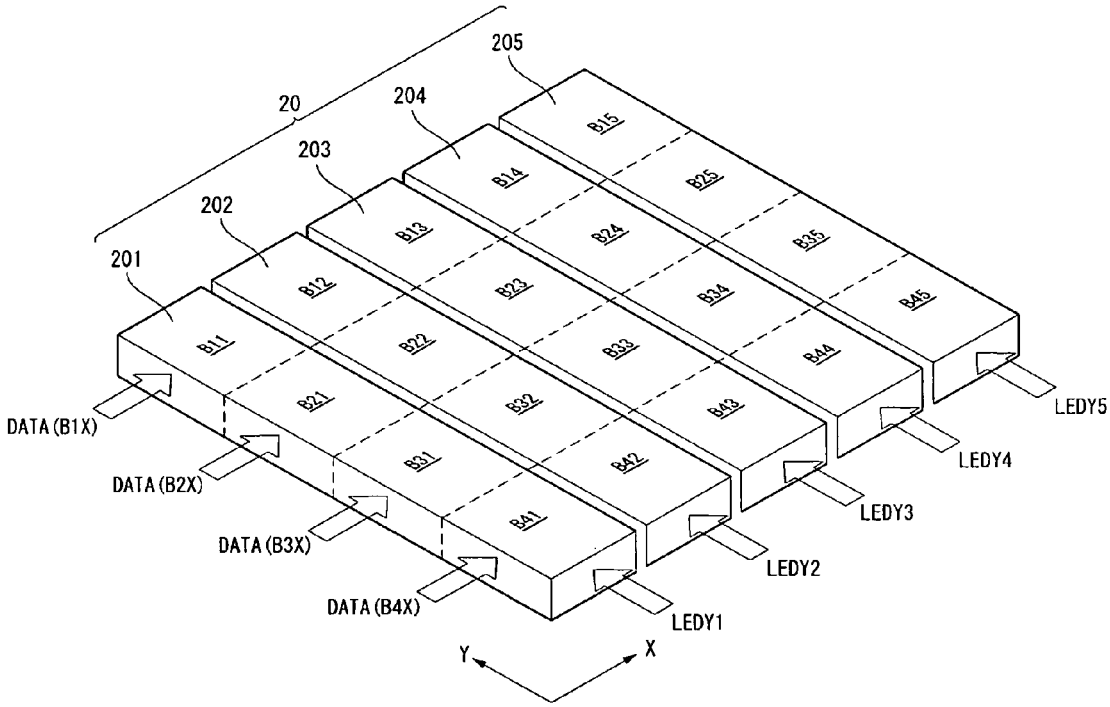
FIGS. 11 and 12B are enlarged perspective views showing a part of a light guide plate in which the blocks shown in FIG. 10 are partitioned.

As one example, the light guide plate part 20 includes a light guide plate array including a plurality of light guide plates 201 to 205 which are arranged in parallel with each other along X-direction to define Y-directional light guide columns as shown in FIG. 11. In this case, the light sources 22 are disposed to face upper and/or under side of the light guide plate part 20 in the drawing to illustrate light to the Y-directional light guide columns, respectively. In FIG. 11, symbols LEDY1 to LEDY5 indicate light which illustrates from the light sources 22 to light incident surfaces of the light guide plates 201 to 205, and divide display luminance of the display screen in a unit of Y-directional light guide column. Also, symbols DATA(B1X) to DATA(B4X) indicate modulation block data which are to divide the display luminance of the display screen in a unit of X-directional data block row. The local dimming is implemented by controlling the display luminance in a block unit using lights LEDY1 to LEDY5 and the modulation block data DATA(B1X) to DATA(B4X) which are independently controlled, respectively.

Figure 12A:
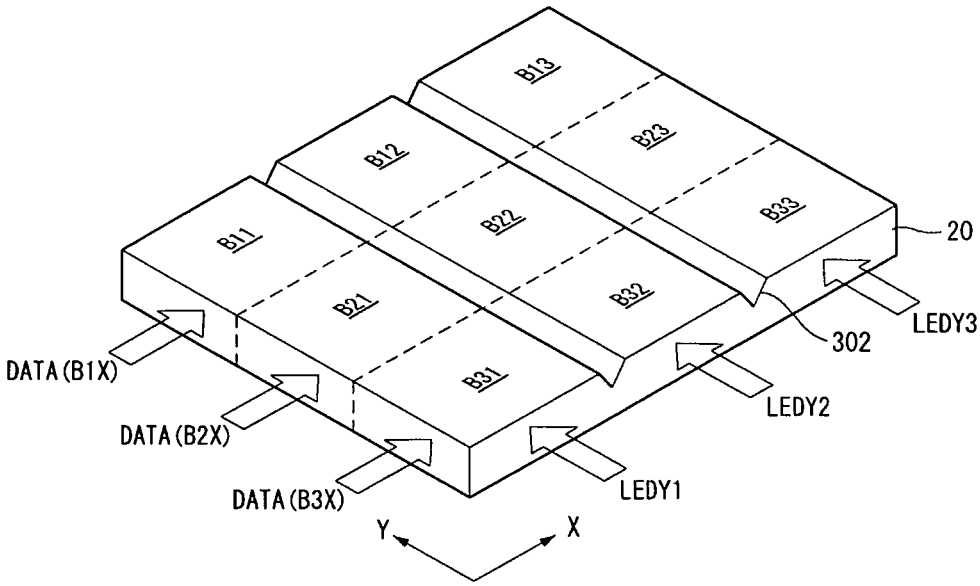
Figure 12B:
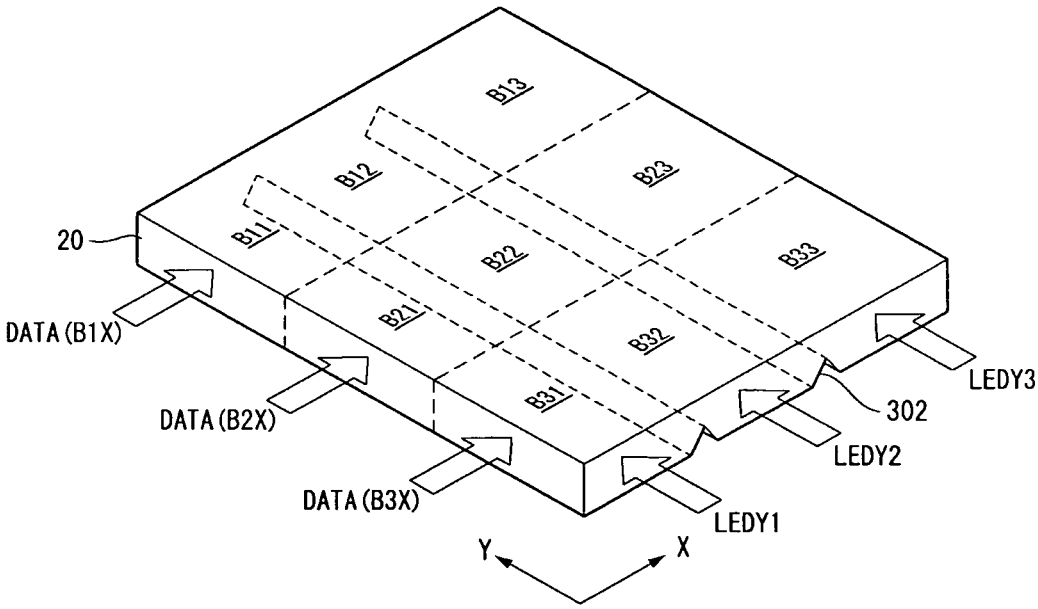

As another example, the light guide plate part 20 includes a single light guide plate in which Y-directional intaglio pattern lines 302 are formed to define Y-directional light guide columns as shown in FIGS. 12A to 12B. FIG. 12A shows an example in which Y-directional intaglio pattern lines are formed on an upper surface of the light guide plate part 20, and FIG. 12B shows another example in which Y-directional intaglio pattern lines are formed on an under surface of the light guide plate part 20. In these cases, the light sources 22 are disposed to face upper and/or under side of the light guide plate part 20 in the drawing to illustrate light to the Y-directional light guide columns, respectively. The Y-directional intaglio pattern lines 302 enhance going-straight property of light from the light sources 20. Each of the Y-directional intaglio pattern lines 302 is formed by linear groove having a depth smaller than the thickness of the light guide plate part 20 to divide the light guide plate part 20 into a plurality of Y-directional light guide columns. In FIGS. 12A and 12B, symbols LEDY1 to LEDY5 are indicate light which illustrates from the light sources 22 to light incident surfaces of the light guide plate part 20, and divide display luminance of the display screen in a unit of Y-directional light guide column. Also, symbols DATA(B1X) to DATA(B4X) indicate modulation block data which are to divide the display luminance of the display screen in a unit of Y-directional data block column. The local dimming is implemented by controlling the display luminance in a block unit using lights LEDY1 to LEDY5 and the modulation block data DATA(B1X) to DATA (B4X) which are independently controlled. The intaglio patter lines 302 can be implemented in a variety of sectional shapes such as a rectangular shape, a triangular shape, a semi-spherical shape, an oval shape or a combination thereof as shown in FIGS. 6A to 6C. It is possible to adjust a depth H, width D and distance of the intaglio pattern lines according to a block size shown in FIG. 10 and size and resolution of the liquid crystal display panel. On the light guide plate 20 of FIGS. 11 to 12B, minute intaglio or embossed patterns 401 are formed.

As above-mentioned, the liquid crystal display and the method of driving the same according to embodiments of the disclosure can implement local dimming and achieves slimness of the liquid crystal display by forming light guide channels on a light guide plate part of an edge type backlight unit and modulating the data supplied to horizontal or vertical directional data block channels to define luminance blocks in which luminance is independently controlled.

It will be apparent to those skilled in the art that various modifications and variations can be made to the structure of the invention without departing from the scope or spirit of the invention. In view of the foregoing, it is intended that the specification and examples to be considered as exemplary only, with a true scope and spirit of the invention being indicated by the following claims and their equivalents.

What is claimed is:

1. A liquid crystal display comprising:

a liquid crystal display panel which displays a picture;

a backlight unit including a light guide plate part in which a plurality of light guide channels are formed, and a plurality of light sources for illuminating light to the light guide channels, wherein the backlight unit divides surface light which is illustrated to the liquid crystal panel to correspond to the plurality of light guide channels;

a division driving controller for mapping an input picture to a plurality of blocks in which a plurality of data channels are intersected with the plurality of light guide channels, analyzing luminance of the input picture for each block, determining dimming values of the plurality of light sources, and independently modulating the luminance of the input picture for each block based on the analyzed result, wherein the division driving controller comprises: a picture analyzer for obtaining a target luminance value for each block of the input picture; a data modulator for determining a first luminance value for each block in consideration of the target luminance and modulating the input picture according to the first luminance value; and a dimming controller for determining a second luminance value for each block in consideration of the target luminance and determining the dimming values according to the second luminance value, wherein the target luminance value for each block is obtained by summing the first luminance value and the second luminance value; and a light source driver for independently controlling luminance of the light sources responding to the dimming values, wherein the light guide plate part comprises a single light guide plate in which a plurality of intaglio pattern lines are formed on an upper surface of the single light guide plate in parallel with a propagation direction of the light illuminated from the light sources to the single light guide plate to define the light guide channels.

2. The liquid crystal display of claim 1, wherein the first and second luminance values are sequentially determined, the luminance value which is determined previously is determined referring to the luminance value which is determined later.

3. The liquid crystal display of claim 1, wherein the light source driver scanning-drives or normal-drives the light sources using the dimming values.

4. A method for driving a liquid crystal display having a liquid crystal display panel on which a picture is displayed, the method comprising:

(a) dividing surface light which is illustrated to the liquid crystal panel to correspond to a plurality of light guide channels using a light guide plate part in which the plurality of light guide channels are formed and a plurality of light sources for illuminating light to the light guide channels;

(b) mapping an input picture to a plurality of blocks in which a plurality of data channels are intersected with the plurality of light guide channels, analyzing luminance of the input picture for each block, determining dimming values of the plurality of light sources, and independently modulating the luminance of the input picture for each block based on the analyzed result, obtaining a target luminance value for each block of the input picture; determining a first luminance value for each block in consideration of the target luminance and modulating the input picture according to the first luminance value; and determining a second luminance value for each block in consideration of the target luminance and determining the dimming values according to the second luminance value, wherein the target luminance value for each block is obtained by summing the first luminance value and the second luminance value; and (c) independently controlling luminance of the light sources responding to the dimming values, wherein the light guide plate part comprises a single light guide plate in which a plurality of intaglio pattern lines are formed on an upper surface of the single light guide plate in parallel with a propagation direction of the light illuminated from the light sources to the single light guide plate to define the light guide channels.

5. The method of claim 4, wherein the first and second luminance values are sequentially determined, the luminance value which is determined previously is determined referring to the luminance value which is determined later.

* * * * *